US008651641B2

(12) United States Patent
Matsumoto

(10) Patent No.: US 8,651,641 B2
(45) Date of Patent: Feb. 18, 2014

(54) LIQUID CONTAINER

(71) Applicant: Seiko Epson Corporation, Tokyo (JP)

(72) Inventor: Akihito Matsumoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/719,400

(22) Filed: Dec. 19, 2012

(65) Prior Publication Data

US 2013/0187992 A1 Jul. 25, 2013

(30) Foreign Application Priority Data

Dec. 21, 2011 (JP) ..... 2011-279461

(51) Int. Cl.
*B41J 2/175* (2006.01)

(52) U.S. Cl.
USPC ..... 347/86

(58) Field of Classification Search
USPC ..... 347/84–86
See application file for complete search history.

(56) References Cited

U.S. PATENT DOCUMENTS

| | | | |
|---|---|---|---|
| 5,381,172 | A | 1/1995 | Ujita et al. |
| 2006/0038865 | A1 | 2/2006 | Nagasaki et al. |
| 2006/0221152 | A1 | 10/2006 | Katada |

FOREIGN PATENT DOCUMENTS

| | | | |
|---|---|---|---|
| JP | 10-114082 | A | 5/1998 |
| JP | 3115660 | B2 | 12/2000 |
| JP | 2001-232812 | A | 8/2001 |
| JP | 2003-145785 | A | 5/2003 |
| JP | 2003-320677 | A | 11/2003 |
| JP | 2006-069051 | A | 3/2006 |
| JP | 2006-089687 | A | 4/2006 |
| JP | 2006-231669 | A | 9/2006 |
| JP | 2006-272902 | A | 10/2006 |
| JP | 2007-083497 | A | 4/2007 |
| JP | 2009-226726 | A | 10/2009 |
| WO | WO-2006/019034 | A1 | 2/2006 |

*Primary Examiner* — Kristal Feggins
(74) *Attorney, Agent, or Firm* — Global IP Counselors, LLP

(57) ABSTRACT

An ink cartridge is adapted to be mounted in a holder of a printer and includes: an ink containing bag which is configured in a bag shape and capable of containing a liquid in an inner portion; a flow path member having a flow path that guides the ink contained in the ink containing bag to an outside and a supply port connected to the flow path; and a containing box including a plant derived material accommodating the liquid containing bag; in which an outermost layer forming an outer surface of the ink containing bag has a shock buffering section that buffers against an impact from the outside via the containing box.

8 Claims, 10 Drawing Sheets

LIQUID CONTAINER

CROSS-REFERENCE TO RELATED APPLICATION

This application claims priority on the basis of Japanese Patent Application No. 2011-279461 filed on Dec. 21, 2011, and the entire disclosure thereof is incorporated herein by reference.

BACKGROUND

1. Technical Field

The present invention relates to a liquid container where it is possible for a liquid to be contained.

2. Related Art

Ink jet printers, which record images or text by ejecting ink onto a print medium from a plurality of nozzles which are provided in a print head, are widely used. In the ink jet printers, an ink cartridge containing ink is mounted in a holder and ink is supplied to the print head from the ink cartridge.

In the life cycle from the manufacturing to the disposal of the ink cartridge, it is desirable to reduce the burden on the environment as much as possible. In the past, there have been known ink cartridges with a configuration in which an ink pack which is formed by a thermoplastic film material is contained in an outer box which is formed of paper and ink cartridges with a configuration in which a so-called gusset type ink pack is contained in a cartridge case which is formed of paper.

As an example of these technologies, Japanese Unexamined Patent Application Publication No. 2006-69051 discloses an ink containing bag which is formed of a flexible film material and an ink cartridge which is formed of a containing box which accommodates the ink containing bag. In this ink cartridge, in order to hold the ink containing bag in the accommodating box, a position regulating member is interposed therebetween as a shock buffering member. In addition, as another example, Japanese Unexamined Patent Application Publication No. 2007-83497 discloses a shock buffering section which is formed as ribs in an ink pack tray body which accommodates a flexible ink pack.

In an ink cartridge which uses such a flexible ink containing bag, the ink accommodating bag is damaged by impacts which are caused by falls during transportation or the like, ink leaks are possible and countermeasures for this are necessary. However, with the technique of Japanese Unexamined Patent Application Publication No. 2006-69051, since the position regulating member as the shock buffering member is configured by cardboard, the work at the time of assembling the cartridge becomes complicated. In addition, the technique of Japanese Unexamined Patent Application Publication No. 2007-83497 does not consider impacts which are generated between an inner surface of the ink pack body and the ink pack.

Here, such problems are in common with a liquid container which is adapted to be mounted in a liquid container holder of a liquid consuming apparatus without being limited to ink cartridges which are mounted in a holder of an ink jet printer.

The present invention is based on solving the problems of the techniques in the prior art, and has the object of providing a liquid container with excellent impact resistance during falls and easy assembly which reduces the environmental burden in the life cycle of the liquid container.

SUMMARY

The present invention has been made to solve at least a portion of the problems described above, and realization in the below embodiments or aspects is possible.

A liquid container according to a first aspect is adapted to be mounted in a liquid container holder of a liquid consuming apparatus and is provided with: a liquid containing bag configured in a bag shape and capable of containing a liquid in an inner portion; a flow path member having a flow path that guides a liquid contained in the liquid containing bag to an outside, and a supply port connected to the flow path; and a containing box including a plant derived material which accommodates the liquid containing bag, in which a shock buffering section that buffers against an impact from the outside via the containing box is provided in a layer forming an outer surface of the liquid containing bag.

In the liquid container of the first aspect, the liquid containing bag, which is configured in a bag shape and where it is possible for a liquid to be contained in an inner portion, is contained in the containing box. Since the containing box is formed using a plant derived material, it is possible to reduce the environmental burden in the life cycle of the liquid container. If the containing box is formed to include the plant derived material, impact resistance when dropped during transport is small when compared with a containing box which is formed with a material such as plastic in a case where the thicknesses are the same. However, in the aspect described above, the shock buffering section is provided in the layer which forms the outer surface of the liquid containing bag. For example, even when the liquid container is accidentally dropped during transportation or the like, the shock buffering section reduces an impact which is applied to the containing box and the liquid containing bag is not easily damaged. As such, it is possible to prevent the liquid which is contained inside the liquid containing bag from leaking out to the outside.

In addition, since the shock buffering section is provided in the layer which forms the outer surface of the liquid containing bag, it is possible for the handling, assembly, and the like of the liquid container to be easy. That is, when the liquid containing bag is accommodated inside the containing box, it is possible to accommodate the shock buffering section at the same time as the liquid containing bag and the assembly work is easy. Moreover, since the shock buffering section elastically changes shape when the liquid containing bag is accommodated in the containing box, it is possible to easily accommodate the liquid containing bag and the assembly work is easy even when the space between the liquid containing bag and the containing box is narrow.

In a liquid container according to a second aspect, in the aspect described above, the shock buffering section is arranged at least at an angular portion of the liquid containing bag. Due to this configuration, in a case where the containing box receives an external force, it is easy for the angular portion of the liquid containing bag to receive a greater impact than the other portions, and buffering is achieved effectively by receiving such an impact in a more focused manner than other portions. Moreover, since the shock buffering section is provided in a portion of the liquid containing bag, it is possible to reduce the amount of materials of the shock buffering section and this is effective in cost reduction. Here, the angular portions of the liquid containing bag refer to portions which protrude from the layer which forms the outer surface of the liquid containing bag and to locations, which protrude from the layer which forms the outer surface of the liquid containing bag such that the distance to the containing box becomes narrower than other portions, other than corner portions of the liquid containing bag.

In a liquid container according to a third aspect, in the aspect described above, it is possible for the shock buffering section to be configured by a hollow shock buffering material having a plurality of hollow bodies forming a hollow chamber. Due to this configuration, the hollow shock buffering material which configures the shock buffering section reduces an impact which is caused by an external force by the hollow chamber of the hollow bodies being compressed when the liquid containing bag receives an external force from the containing box. Here, by configuring the hollow chamber with independent hollows which are sealed with regard to the outside, it is possible for the hollow bodies to further increase the action of reducing an impact.

In a liquid container according to a fourth aspect, in the aspect described above, the liquid container is a liquid container in which at least two flexible sheets are bonded at a bonding section, and it is possible for the shock buffering section to adopt a configuration of being formed on a surface of the flexible sheet away from the bonding section. In this configuration, the liquid containing bag is formed in a bag shape by bonding at least two flexible sheets at a bonding section. At this time, if the shock buffering section is provided in the bonding section, when adhering and forming the bonding section, the bonding section interposes the shock buffering section and receives a crimping force, and it is easy for a decrease in the crimping force and variations in the bonding state to be generated. In order to avoid such a decrease in the crimping force or the like, the shock buffering section is formed on the flexible sheet away from the bonding section.

In a liquid container according to a fifth aspect, in the aspect described above, the liquid containing bag has a first layer and a second layer that include a material mainly composed of paper, the first layer includes a material that is resistant to penetration with regard to the liquid, and the second layer has the shock buffering section configured by a predetermined three-dimensional structure. In this configuration, since the liquid containing bag is formed of a plurality of layers using a plant derived material mainly composed of paper, it is possible to reduce the environmental burden in the life cycle of the liquid container.

In a liquid container according to a sixth aspect, in the aspect described above, the liquid containing bag is provided with an in-bag flow path that guides the liquid contained in a liquid containing space of the inner portion thereof to the supply port, the shock buffering section is provided with a concave section formed facing the liquid containing space of the liquid containing bag, and the concave section constitutes a portion of the in-bag flow path. In this configuration, the in-bag flow path which is formed inside the liquid containing bag is connected to the supply port of a flow path forming member, guides the liquid smoothly to the supply port, and reduces the remaining amount of the liquid. Since the outer surface of the liquid containing bag is a convex section and acts as the shock buffering section and the inner surface of the liquid containing bag is a concave section and acts as at least a portion of the flow path inside the liquid containing bag, it is possible to simplify the in-bag flow path.

In a liquid container according to a seventh aspect, in the aspect described above, the containing box is provided with a box side shock buffering section that buffers against an impact from the outside by a top portion of the shock buffering section hitting an inner wall portion that opposes the shock buffering section of the liquid containing bag. In this configuration, by the top portion of the shock buffering section of the liquid containing bag hitting the box side shock buffering section of the containing box, the liquid containing bag is positionally aligned with regard to the containing box. As such, it is possible for the liquid containing bag to reduce rattling of the liquid containing bag, in particular, it is possible to buffer against an impact which is applied to the place of connection with the flow path member and it is possible to further prevent leaking of liquid.

DESCRIPTION OF EMBODIMENTS

A. First Working Example

A-1. Printer Configuration

Figure 1:
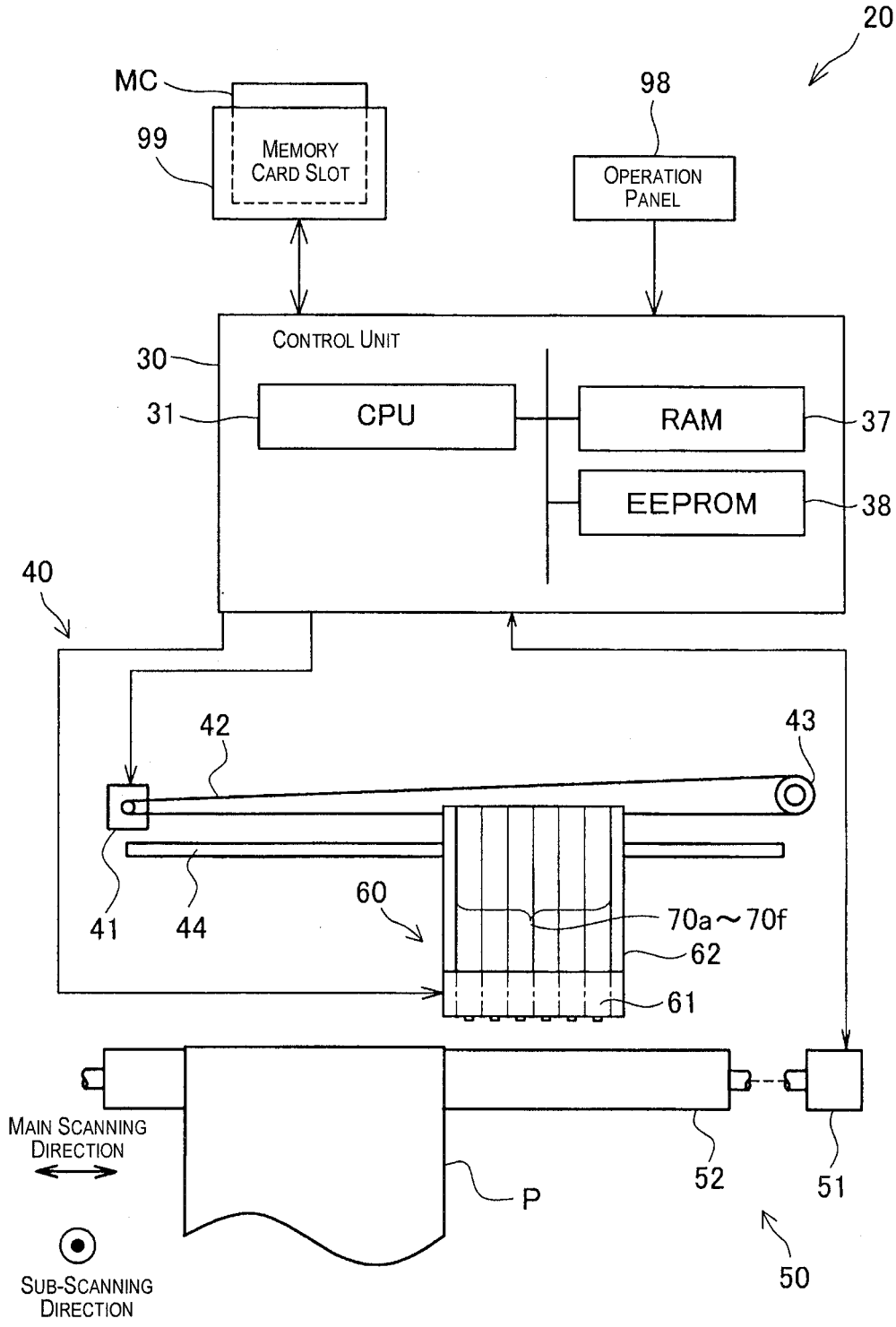
FIG. 1 is an explanatory diagram illustrating a schematic configuration of a printer 20 in a first working example of the present invention.

Next, embodiments of the present invention will be described based on working examples. FIG. 1 is an explanatory diagram illustrating a schematic configuration of a printer 20 in a first working example of the present invention. The printer 20 in the present working example is an ink jet printer which forms ink dots on a print medium by ejecting ink from a plurality of nozzles, and thereby records characters, graphics, images or the like on the print medium. The printer 20 is one liquid consuming apparatus which consumes ink as a liquid.

As shown in FIG. 1, the printer 20 is provided with a print head unit 60 on which a print head 61 is mounted, a print head unit transport mechanism 40 which performs main scanning in which the print head unit 60 is moved back and forth along a direction which is parallel to a shaft of a platen 52, a paper transport mechanism 50 which performs sub-scanning in which a paper sheet P as a print medium is transported in a direction (sub-scanning direction) which intersects with the main scanning direction, an operation panel 98 which receives various instructions and setting operations relating to printing, a memory card slot 99 which is able to connect to a memory card MC which is a storage medium, and a control unit 30 which controls each of the sections of the printer 20.

The paper transport mechanism 50 has a motor 51. The rotation of the motor 51 is transmitted to a paper sheet transport roller (not shown) through a gear train (not shown). Then, the paper sheet P is transported along the sub-scanning direction by the rotation of the paper sheet transport roller.

The print head unit transport mechanism 40 has a motor 41, a pulley 43 which stretches an endless driving belt 42 to the motor 41, and a shaft 44 which is constructed in parallel to the shaft of the platen 52 and which holds the print head unit 60 so as to be able to slide. The rotation of the motor 41 is transmitted to the print head unit 60 through the driving belt 42. Due to this, the print head unit 60 is moved back and forth along the shaft 44.

A plurality of ink cartridges 70 (70*a* to 70*f*) are mounted in a holder 62 of the print head unit 60 as liquid containers which respectively contain inks of predetermined colors (for example, cyan (C), light cyan (Lc), magenta (M), light magenta (Lm), yellow (Y), and black (K)). Here, in the following description, the plurality of ink cartridges 70*a* to 70*f* are also simply referred to as the ink cartridges 70. In the present working example, the ink cartridges 70 are mounted in the holder 62 from above in the direction of gravity. The ink which is contained in the ink cartridges 70 which are mounted in the holder 62 is supplied to the print head 61. The print head 61 has a plurality of nozzles which eject ink, and nozzle actuators (for example, piezoelectric elements) which are provided to correspond to each of the nozzles. If the nozzle actuators are driven by a predetermined driving signal, a vibrating plate inside a cavity (pressure chamber) which links with the nozzles is displaced and a pressure change is generated inside the cavity. The ink is ejected from the corresponding nozzles according to the pressure change.

The control unit 30 includes a CPU 31 which executes various types of calculation processes, a RAM 37 which temporarily stores and develops programs and data, and an EEPROM 38 which stores programs and the like which are executed by the CPU 31. The various types of functions of the control unit 30 are realized by the CPU 31 developing and executing the programs which are stored in the EEPROM 38 using the RAM 37. Here, at least a portion of the functions of the control unit 30 may be realized by operating an electrical circuit which is provided in the control unit 30 based on the circuit configuration thereof.

In the printer 20 which is configured in this manner, since printing is performed based on print target data which is input through the memory card slot 99, the control unit 30 performs control of each section of the printer 20 in accordance with instructions from the user through the operation panel 98. Due to this, the main scanning in which the print head unit 60 is moved back and forth while ink is ejected from the nozzles and the sub-scanning in which the paper sheet P is transported in the sub-scanning direction are repeatedly executed and the recording of an image or the like on the paper sheet P is realized.

A-2. Ink Cartridge Configuration

Next, the configuration of the ink cartridge 70 in the present working example will be described. As described above, in the printer 20 of the present working example, six ink cartridges 70 (70*a* to 70*f*) are mounted in the holder 62, but the configuration of each of the ink cartridges 70 is basically the same.

Figure 2:
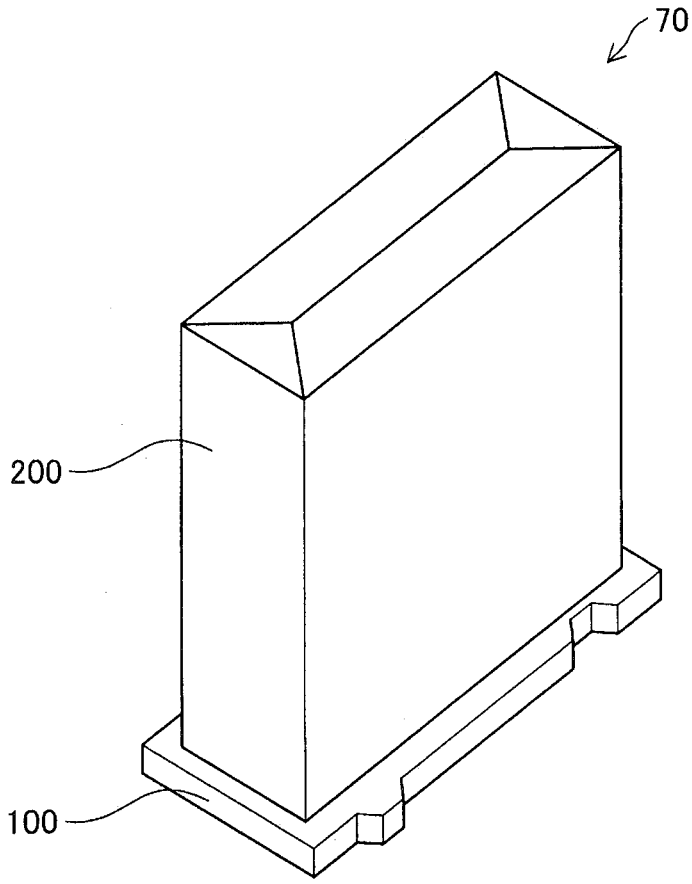
FIG. 2 is an explanatory diagram illustrating a basic configuration of an ink cartridge 70.
Figure 3:
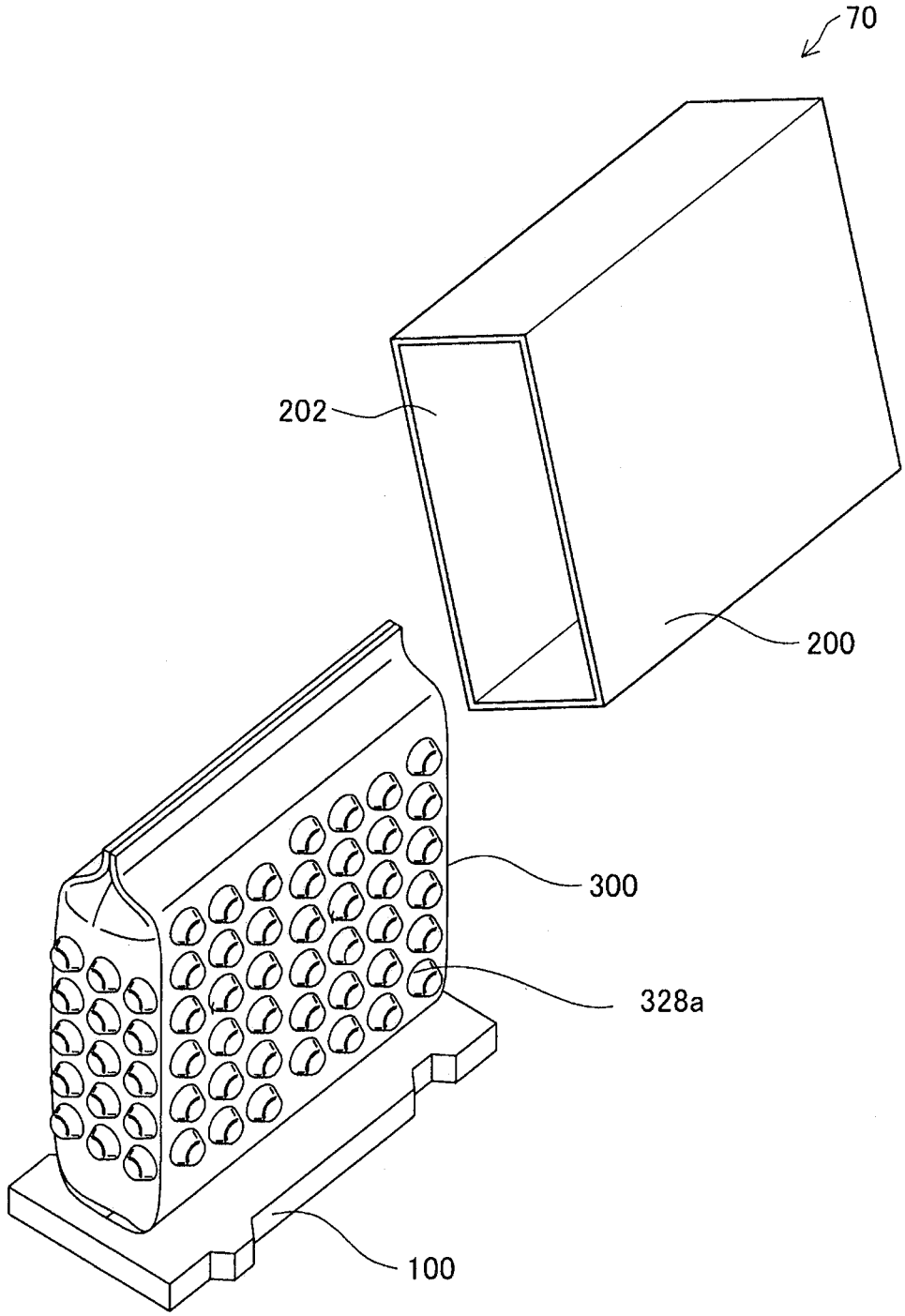
FIG. 3 is an explanatory diagram illustrating a basic configuration of the ink cartridge 70.
Figure 4:
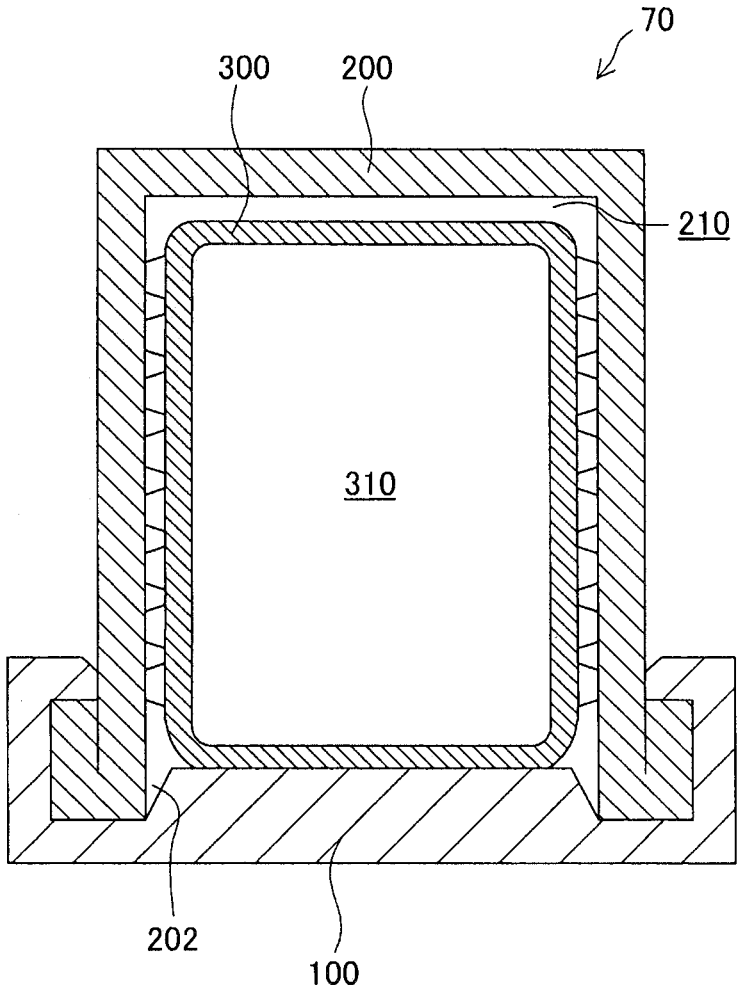
FIG. 4 is an explanatory diagram illustrating a basic configuration of the ink cartridge 70.

FIGS. 2 to 4 are explanatory diagrams illustrating a basic configuration of the ink cartridge 70. FIGS. 2 and 3 illustrate a schematic configuration of the external appearance of the ink cartridge 70. FIG. 4 illustrates a schematic configuration of a cross section of the ink cartridge 70. The ink cartridges 70 are provided with a flow path member 100, a containing box 200, and an ink containing bag 300 (refer to FIGS. 3 and 4). The ink containing bag 300 is arranged inside a space 210 which is surrounded by the flow path member 100 and the containing box 200 (refer to FIG. 4). Here, in FIG. 3, for convenience of understanding the configuration of the ink cartridge 70, a state where the containing box 200 is detached from the flow path member 100 is illustrated, but when the ink cartridge 70 is mounted in the printer 20 and used, the containing box 200 as shown in FIGS. 2 and 4 is fixed to the flow path member 100. In this state, the ink cartridge 70 is substantially a rectangular shape.

Figure 5:
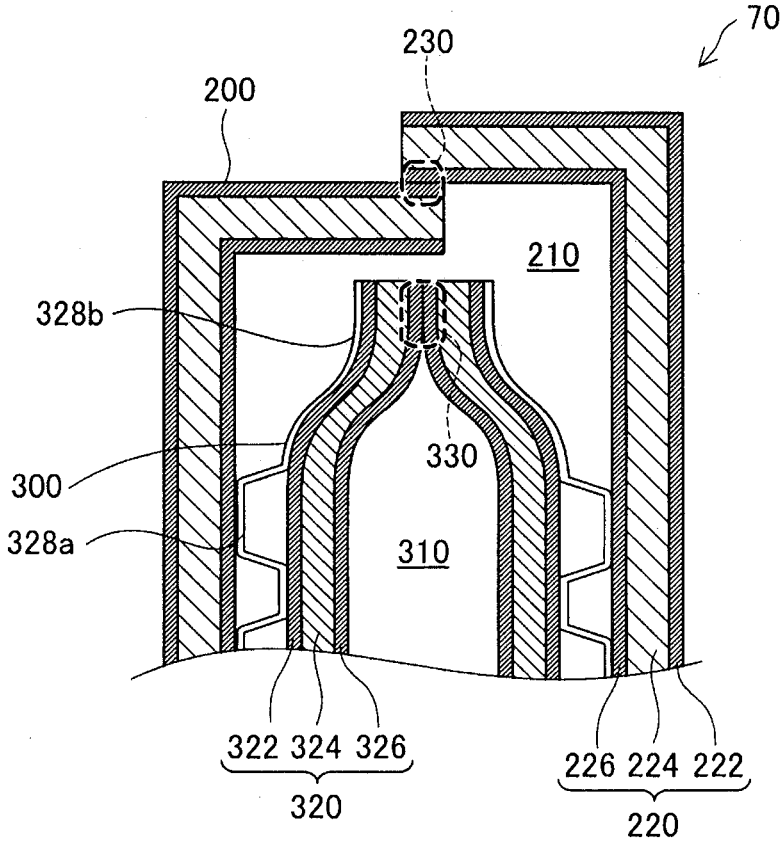
FIG. 5 is a partial cross sectional diagram illustrating a detailed configuration of an ink containing bag 300 and a containing box 200.

The ink containing bag 300 is a bag which is formed of a flexible material and which has an ink containing space 310 where it is possible for ink to be contained in an inner portion. As shown in FIG. 3, the ink containing bag 300 is a so-called gusset bag which has a gusset, but may be a so-called pillow type bag which does not have a gusset. FIG. 5 is a partial cross sectional diagram illustrating a detailed configuration of the ink containing bag 300 and the containing box 200. The ink containing bag 300 of the present working example is formed by a flexible sheet 320 with a three layer configuration in which polyethylene layers 322 and 326 are laminated on both sides of an aluminum deposition film 324, and is formed by further laminating a hollow shock buffering material 328 which is formed of polyethylene or the like on the outermost layer of the outer surface of the flexible sheet 320. Specifically, the ink containing bag 300 is manufactured by adhering the flexible sheets 320 at a bonding section 330 and forming a bag shape. The aluminum deposition film 324 has a so-called barrier property and suppresses the passage of liquid or gas through the flexible sheet 320. As a result, phenomena, which cause a decrease in the solvent amount in the ink which is contained inside the ink containing space 310 (increase in ink concentration) or deterioration in ink by the inflow of air into the ink containing space 310, are suppressed.

Figure 6:
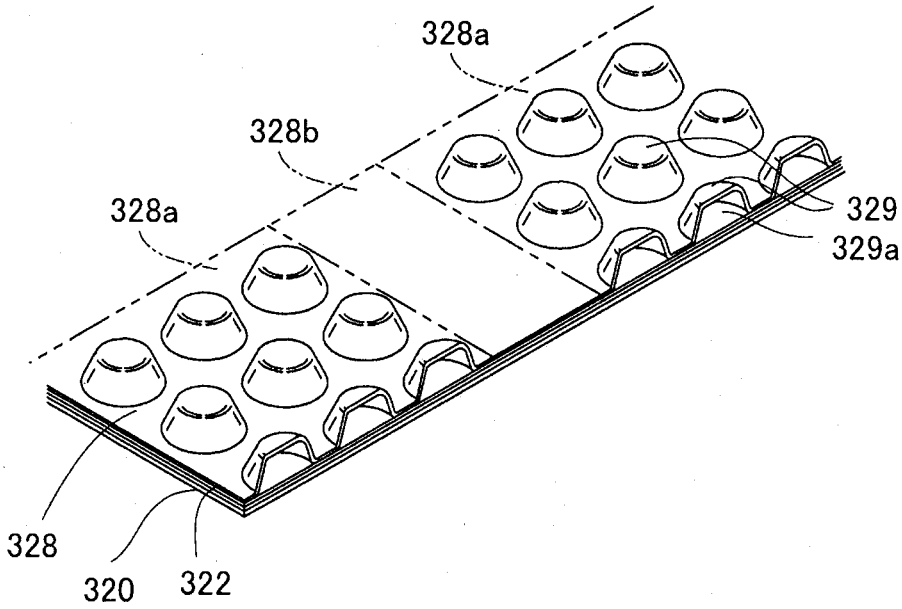
FIG. 6 is a perspective diagram which partially cuts away and illustrates a flexible sheet 320 and a hollow shock buffering material 328.

FIG. 6 is a perspective diagram which partially cuts away and illustrates the flexible sheet 320 and the hollow shock buffering material 328. The hollow shock buffering material 328 is laminated on a polyethylene layer 322 and is provided with a shock buffering section 328*a* and a flat portion 328*b*. The shock buffering section 328*a* is formed of a large number of hollow bodies 329 and the inner side space thereof is set as a hollow chamber 329*a*. The flat portion 328*b* is a portion of a predetermined width where the hollow bodies 329 are not provided, and is arranged at a location in the bonding section 330 of FIG. 5.

Figure 7:
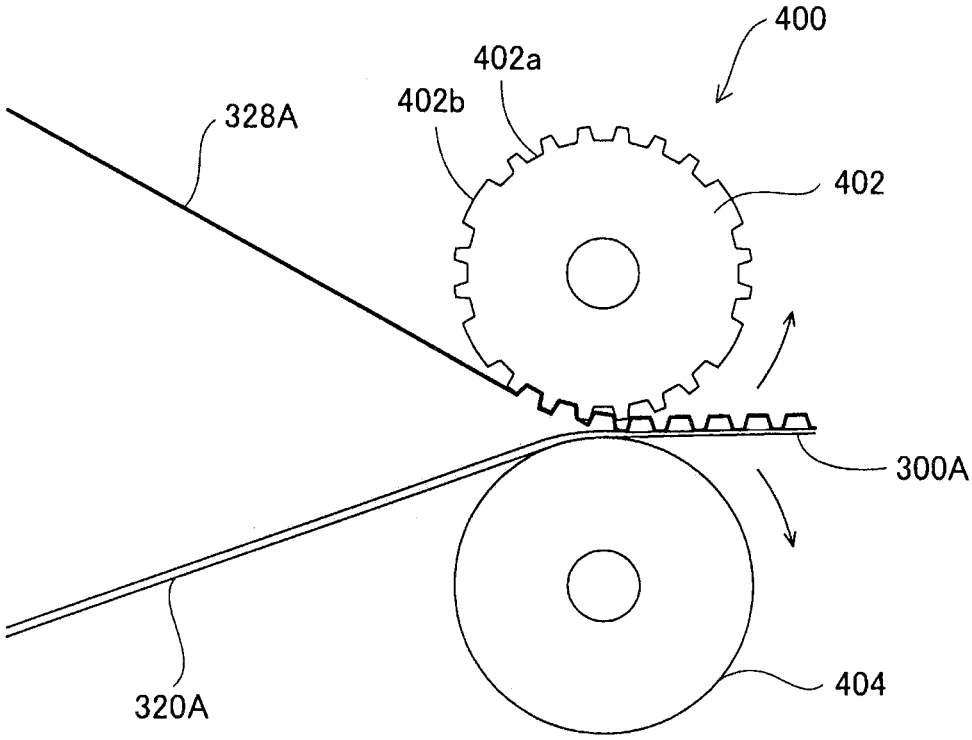
FIG. 7 is an explanatory diagram describing a forming process of a bag sheet 300A for manufacturing the ink containing bag 300.

FIG. 7 is an explanatory diagram illustrating a forming process of the bag sheet 300A for manufacturing the ink containing bag 300. The bag sheet 300A is manufactured by a sheet forming machine 400. The sheet forming machine 400 is provided with a first roller 402 and a second roller 404 which opposes the first roller 402. A concave and convex section 402*a* for forming the hollow bodies 329 described above and a peripheral surface 402*b* for forming the flat section 328*b* with a predetermined gap with the concave and convex section 402*a* in the circumferential direction are provided at a peripheral section of the first roller 402. A compressor which is not shown is connected to the concave and convex section 402*a* of the first roller 402 and performs suctioning of the vicinity of the concave and convex section 402*a*.

In the forming of the bag sheet 300A, a first sheet material 320A which becomes the flexible sheet 320 and a second sheet material 328A which becomes the hollow shock buffering material 328 are transported between the first roller 402 and the second roller 404 in a state of being heated while the first roller 402 and the second roller 404 are rotationally driven and are compressed between both rollers. Due to this, in the first sheet material 320A, since the vicinity of the concave and convex section 402*a* of the first roller 402 is suctioned by an air compressor, a large number of hollow bodies 329 (FIG. 6) which follow the shape of the concave and convex section 402*a* are formed, and the flat section 328*b* (FIG. 6) which follows the shape of the peripheral surface 402*b* with no concave and convex section 402*a* is formed. At the same time as this, the first sheet material 320A and the second sheet material 328A are heat pressed, and the bag sheet 300A in which the flexible sheet 320 and the hollow shock buffering material 328 are integrated is formed.

Figure 8:
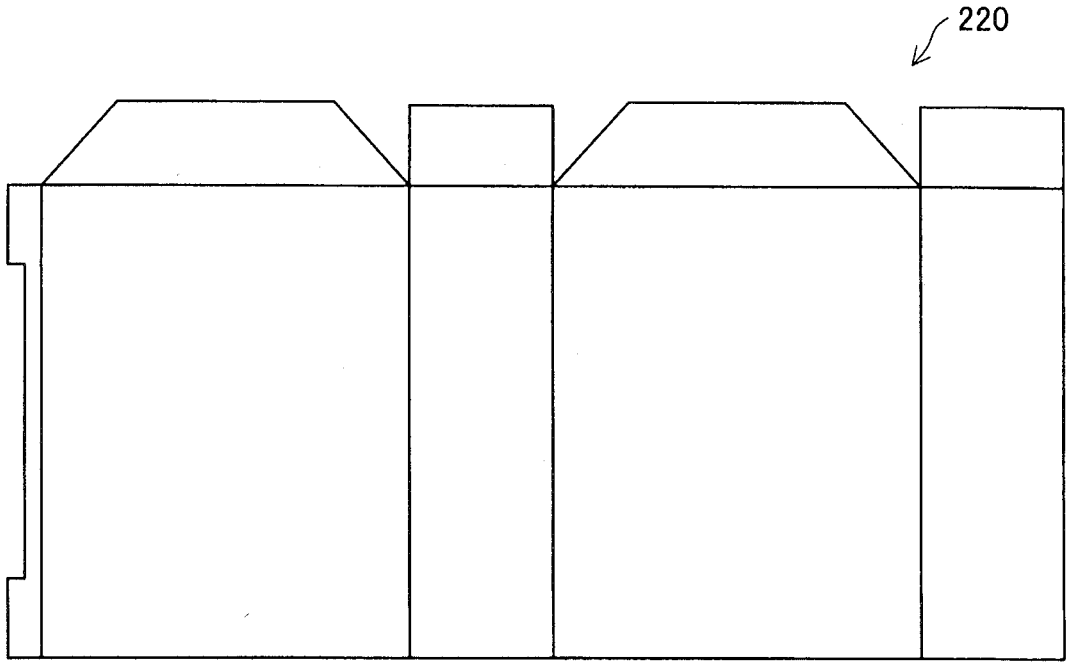
FIG. 8 is an explanatory diagram illustrating a configuration of a paper material 220.

The containing box 200 is substantially a rectangular shaped box which is formed by a paper material which is a plant derived material. However, one surface inside of the six surfaces which define the substantially rectangular shape of the containing box 200 is an opening 202 (refer to FIG. 3). As will be described later, the containing box 200 is fixed with regard to the flow path member 100 such that the opening 202 is blocked by the flow path member 100 (refer to FIG. 4). The containing box 200 of the present working example is formed by the paper material 220 with a three layer configuration in which polyethylene layers 222 and 226 are laminated on both sides of paper 224 (refer to FIG. 5). The containing box 200 is manufactured by bending one sheet of the paper material 220 shown in FIG. 8, adhering at a bonding section 230 (refer to FIG. 4), and assembling in a box shape. Since the containing box 200 has a constant rigidity in comparison with the ink containing bag 300, it is possible to protect the ink containing bag 300 which is formed by the flexible material during the product transportation of the ink cartridge 70 or during mounting and use in the ink cartridge 70. Here, since the containing box 200 surrounds the ink containing bag 300, it is also possible to be represented as surrounding the ink containing space 310 which is formed inside the ink containing bag 300. In the present specifications, "surrounding" a target object (or target space) using a certain object has the meaning that the object configures at least a portion of a surface which encloses the target object (or target space) without being limited to a case where the object completely encloses the target object (or target space).

Figure 9:
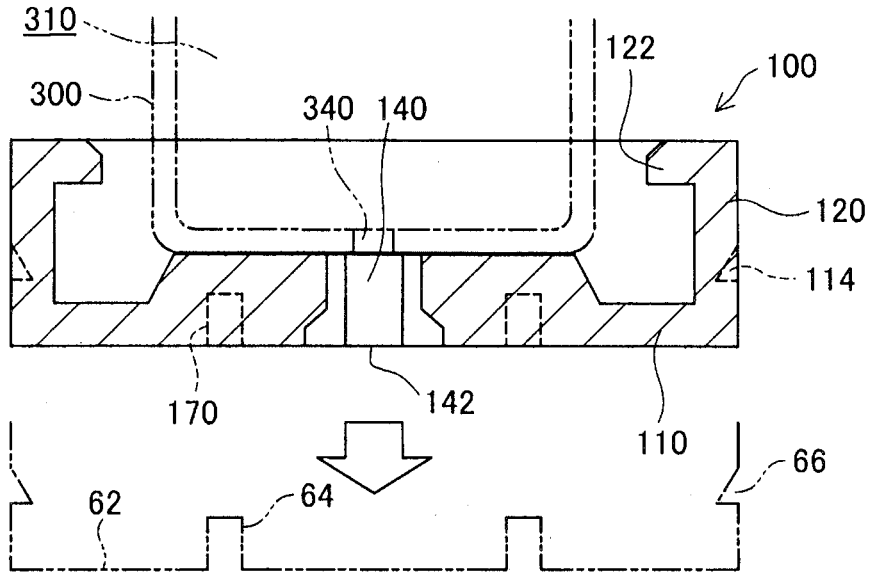
FIG. 9 is an explanatory diagram illustrating a detailed configuration of a flow path member 100.
Figure 10:
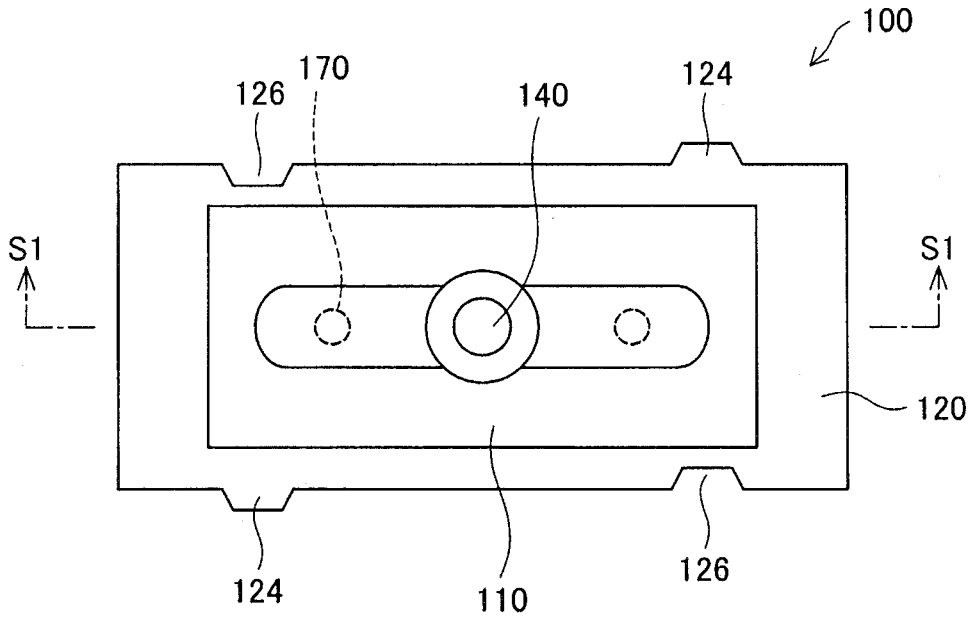
FIG. 10 is an explanatory diagram illustrating a detailed configuration of the flow path member 100.

FIGS. 9 and 10 are explanatory diagrams illustrating a detailed configuration of the flow path member 100. FIG. 10 illustrates a planar configuration of a side which opposes the containing box 200 of the flow path member 100, and FIG. 9 illustrates a cross sectional configuration of the flow path member 100 in S1-S1 position in FIG. 10. The flow path member 100 is formed using a resin material (for example, polypropylene) with higher rigidity than the paper material which is the material of the containing box 200. The flow path member 100 has a shape which has a base section 110 with a substantially flat shape and a protruding section 120 which is formed across the peripheral edge of the base section 110 and which protrudes toward the side (upper side in FIG. 9) which opposes the containing box 200. A flange section 122 which extends substantially parallel with the base section 110 toward the inner side (center side of the base section 110) is formed at the tip end of the protruding section 120.

A supply port 142, which supplies ink which is contained inside the ink containing space 310 of the ink containing bag 300 to the print head 61 of the printer 20, and a flow path 140, which links the ink containing space 310 and the supply port 142, are formed in the base section 110 of the flow path member 100. More specifically, the ink containing bag 300 is fixed to the flow path member 100 by, for example, adhesion. The ink containing space 310 and the flow path 140 of the flow path member 100 are linked via an opening 340 which is formed in the ink containing bag 300. Then, the ink which is contained in the ink containing space 310 is supplied to the print head 61 via the opening 340, the flow path 140, and the supply port 142. Here, a valve which is not shown is provided in the supply port 142 of the flow path member 100. In order to further reduce the environmental burden, a valve which does not use a metal material (for example, the clean click connector of Pack Plus Ltd., or the Duckbill valve of Vernay Laboratories, Inc.) may be used as the valve.

On the surface (surface of the lower side in FIG. 9) of the opposite side to the side which opposes the containing box 200 of the flow path member 100, two concave sections 170 are formed. When the ink cartridge 70 is mounted in the holder 62, the positional alignment of the ink cartridge 70 with regard to the holder 62 is realized by engaging each of the concave sections 170 of the flow path member 100 with each convex section 64 which is formed in the holder 62. Here, engagement sections (engagement section 114 of the flow path member 100 and engagement section 66 of the holder 62) which prevent the separation of the ink cartridge 70 from the holder 62 are formed in the flow path member 100 and the holder 62 by mutual engagement in a state where the ink cartridge 70 is mounted in the holder 62.

Figure 11:
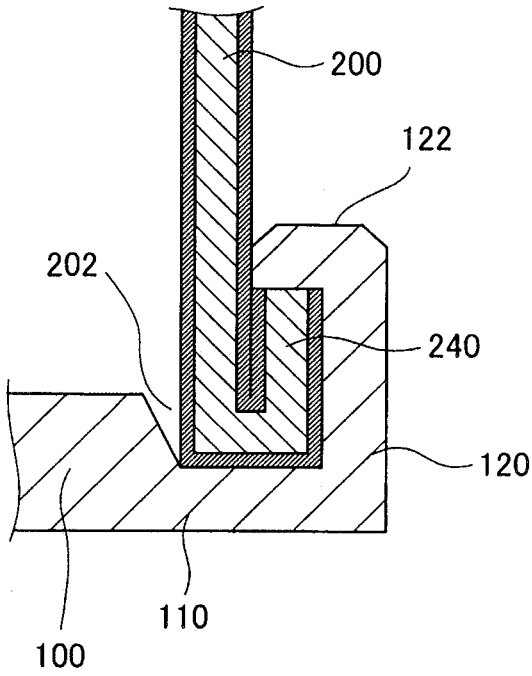
FIG. 11 is an explanatory diagram illustrating in detail a configuration for fixing the containing box 200 and the flow path member 100.

FIG. 11 is an explanatory diagram illustrating in detail a configuration for fixing the containing box 200 and the flow path member 100. The containing box 200 has a folded section 240 along a portion or the whole of the periphery of the opening 202. The folded section 240 is a section with a flap shape which is formed by folding an edge portion of the opening 202 side of the containing box 200 to the outside. That is, the folded section 240 extends in a direction so as to separate from the opening 202 from at least a portion of the edge portion of the opening 202. Accordingly, the thickness of the containing box 200 is greater in the portion in which the folded section 240 is formed than in other portions.

As shown in FIG. 11, the containing box 200 and the flow path member 100 are fixed by the engagement of the folded section 240 and the protruding section 120. More specifically, a gap between the surface of the base section 110 of the flow path member 100 and the surface of the flange section 122 of the protruding section 120 along the direction in which the containing box 200 separates from the flow path member 100 (upward direction in FIG. 11, referred to below as a "first direction") is slightly less than the length of the folded section 240. As a result, when the portion in which the folded section 240 of the containing box 200 is formed pushes into the protruding section 120 side of the flow path member 100, the protruding section 120 pinches the folded section 240 so as to be compressed along the first direction. Due to this, the containing box 200 is fixed to the flow path member 100. Here, in such a fixed state, the flange section 122 of the protruding section 120 prevents movement along the first direction where the containing box 200 separates from the flow path member 100 by the interference of the folded section 240. In this manner, the protruding section 120 which includes the flange section 122 of the flow path member 100 functions as a gripping portion which fixes the containing box 200 and the folded section 240 of the containing box 200 functions as a portion to be gripped which is gripped by the gripping portion.

Since the fixing method of the containing box 200 and the flow path member 100 is as described above, the engagement of the folded section 240 and the protruding section 120 is released by pulling the portion in which the folded section 240 of the containing box 200 is formed so as to separate from the protruding section 120 of the flow path member 100, and the containing box 200 is easily detached from the flow path member 100.

Figure 12:
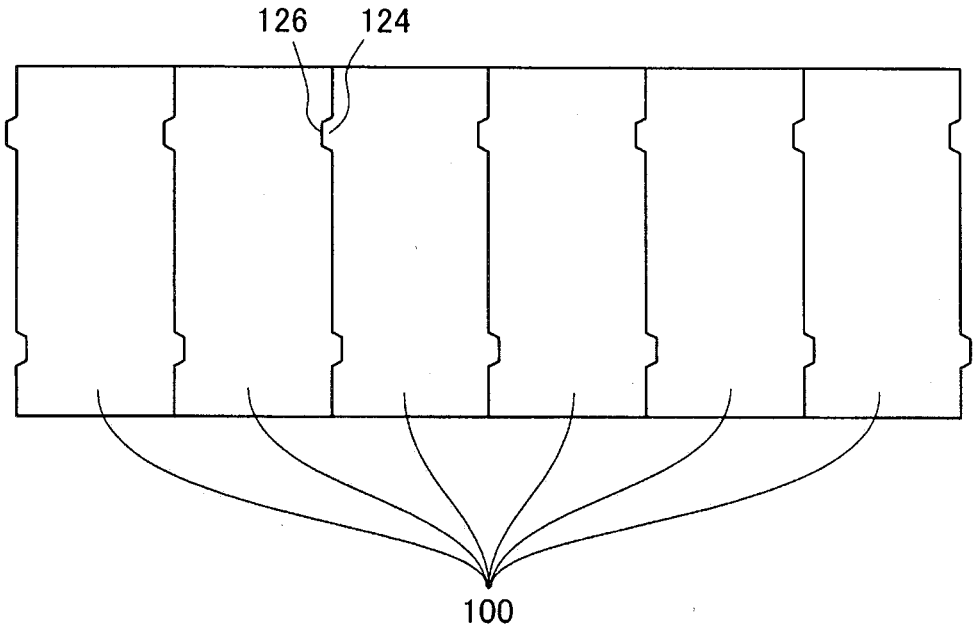
FIG. 12 is an explanatory diagram illustrating a state in which a plurality of the flow path members 100 are lined up.
Figure 13:
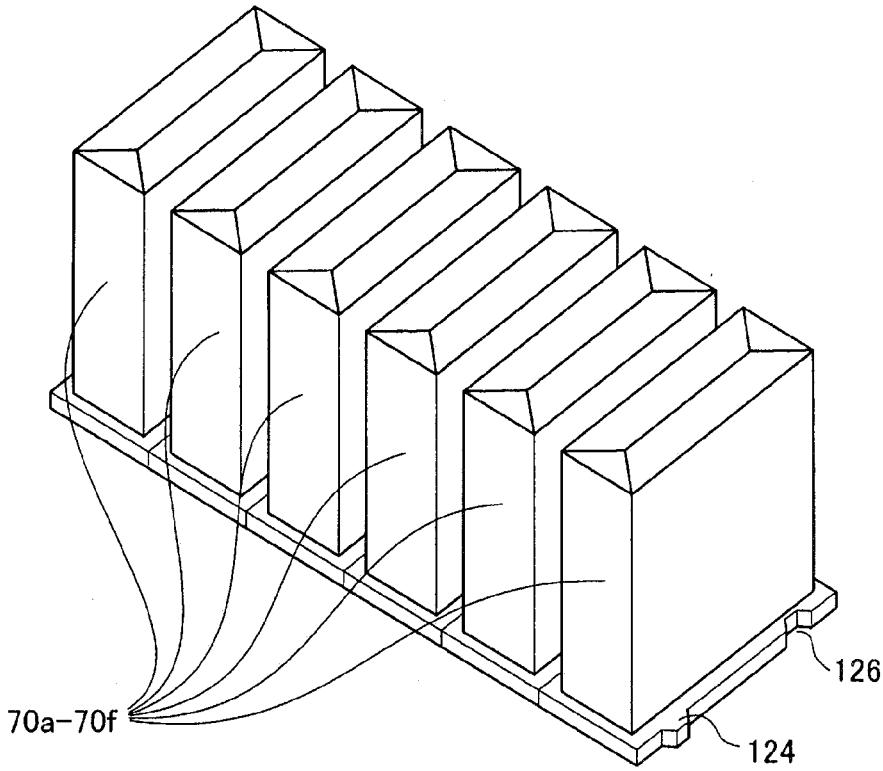
FIG. 13 is an explanatory diagram illustrating a state in which a plurality of ink cartridges 70 are lined up.

As shown in FIG. 10, in the present working example, a concave section 126 is formed at one of one unit of edge surfaces (the upper side edge surface and the lower side edge surface in FIG. 10) which are parallel to each other and which are edge surfaces which are substantially orthogonal with the base section 110 of the flow path member 100, and a convex section 124 which engages with the concave section 126 is formed at the other of the one unit of edge surfaces. Here, in the present working example, the two units of the concave section 126 and the convex section 124 are formed on the one unit of edge surfaces. When a plurality of the flow path members 100 are lined up in this manner, as shown in FIG. 12, the concave section 126 of one flow path member 100 engages with the convex section 124 of another flow path member 100 which is adjacent, and the flow path members 100 are prevented from shifting by being integrated. As a result, as shown in FIG. 13, it is possible to integrate a plurality of the ink cartridges 70 while preventing position shifting relative to each other. Accordingly, for example, in a case where a plurality of the ink cartridges 70 are brought together and transported, it is possible to simplify the packaging.

As described above, in the ink cartridge 70 of the present working example, by surrounding the ink containing bag 300, the containing box 200 which surrounds the ink containing space 310 is formed using paper which is a plant derived material. Therefore, in the ink cartridge 70 of the present working example, it is possible to reduce the environmental burden in the life cycle. In particular, in the ink cartridge 70 of the present working example, by configuring only one surface among the six surfaces which define the substantially rectangular shape of the ink cartridge 70 using the flow path member 100 and configuring the remaining five surfaces using the containing box 200, it is possible to suppress the use of resin material to the minimum and to greatly reduce the environmental burden.

In addition, in the ink cartridge 70 of the present working example, the flow path member 100, which has the supply port 142 which supplies ink which is contained in the ink containing space 310 to the print head 61 and the flow path 140 which links the ink containing space 310 and the supply port 142, is formed using a resin material. In addition, the containing box 200 has the opening 202, and the containing box 200 is fixed with regard to the flow path member 100 such that the opening 202 is blocked by the flow path member 100. As a result, in the ink cartridge 70 of the present working example, it is possible to suppress the generation of defects such as ink leaks by forming the supply port and the flow path for the supply of ink in the flow path member 100 which has comparatively high rigidity. In addition, in the ink cartridge 70 of the present working example, it is possible to stably fix the ink cartridge 70 to the holder 62 of the printer 20 via the flow path member 100 which has comparatively high rigidity. Furthermore, it is possible to stably fix the containing box 200 using the flow path member 100 which has comparatively high rigidity. Accordingly, in the ink cartridge 70 of the present working example, it is possible to suppress the generation of defects such as warping or deforming of the ink cartridge 70 when mounting in the holder 62 or when detaching from the holder 62.

In addition, in the ink cartridge 70 of the present working example, since it is possible to easily detach the containing box 200 from the flow path member 100, it is possible to promote the recycling of the containing box 200. In addition, even assuming a case of disposing of the ink cartridge 70, it is possible to carry out the disposal in a state where the plant derived material and the other materials are separated.

In addition, in the ink cartridge 70 of the present working example, it is possible to suppress the generation of ink leaks since the ink is contained in the ink containing space 310 in the inner portion of the ink containing bag 300 which is formed using flexible material. In particular, in the present working example, since the ink containing bag 300 is formed using a material which has a barrier property, phenomena, which cause a decrease in the solvent amount in the ink which is contained inside the ink containing space 310 (increase in ink concentration) or deterioration in ink by the inflow of air into the ink containing space 310, are suppressed.

In addition, in the ink cartridge 70 of the present working example, the containing box 200 has the folded section 240, and the thickness of the containing box 200 is greater in the portion where the folded section 240 is formed than in the other portions. As a result, it is possible to form a portion which has a large thickness using simple processing with regard to the paper material 220 which is the material of the containing box 200. In addition, by the protruding section 120 of the flow path member 100 which has comparatively high rigidity pinching so as to compress the folded section 240 along the first direction, the containing box 200 is fixed to the flow path member 100. As a result, it is possible to stably fix the containing box 200 to the flow path member 100. In addition, since the folded section 240 of the containing box 200 which functions as the portion to be gripped is provided to be adjacent to the opening 202, it is possible to suppress the size of the protruding section 120 of the flow path member 100 as the gripping portion to the minimum and it is possible to suppress the environmental burden.

In addition, in the ink cartridge 70 of the present working example, due to the forming of the concave section 170 for positionally aligning the ink cartridge 70 with regard to the holder 62 by engaging the convex sections 64 which are formed in the holder 62 with the flow path member 100 which has comparatively high rigidity, it is possible to improve the position alignment precision. In particular, in the ink cartridge 70 of the present working example, since the concave section 170 for positional alignment is formed in a portion where the supply port 142 is provided in the flow path member 100, it is possible to improve the positional alignment precision in the vicinity of the supply port 142, and it is possible to effectively suppress the generation of defects such as ink leaks.

In the liquid container according to the working example described above, the ink containing bag 300, which is configured in a bag shape and where it is possible for a liquid to be contained in an inner portion, is contained in the containing box 200. Since the containing box 200 is formed using a plant derived material, it is possible to reduce the environmental burden in the life cycle of the ink cartridge 70. When the containing box 200 is formed from plant derived material, impact resistance when dropped during transport is smaller than a containing box which is formed with material such as plastic in a case where the thicknesses are the same. However, in the present working example, the shock buffering section

328*a* is provided in the outermost layer which forms the outer surface of the ink containing bag 300. For example, the shock buffering section 328*a* reduces an impact which is applied to the containing box 200 even when the ink cartridge 70 is accidentally dropped during transport or the like and the ink containing bag 300 is not easily damaged. As such, it is possible to prevent the ink which is contained inside the ink containing bag 300 from leaking out to the outside.

In addition, since the shock buffering section 328*a* is provided in the outermost layer of the ink containing bag 300, it is possible for the handling, assembly, and the like to be easy. That is, when the ink containing bag 300 is accommodated inside the containing box 200, it is possible to accommodate the shock buffering section 328*a* at the same time as the ink containing bag 300 and the assembly work is easy. Moreover, since the shock buffering section 328*a* elastically changes shape when the ink containing bag 300 is accommodated in the space 210 of the containing box 200, it is possible to easily accommodate the ink containing bag 300 even if the space 210 is narrow and the assembly work is easy.

Moreover, as shown in FIG. 6, since the shock buffering section 328*a* is configured by the hollow shock buffering material 328 which has the plurality of hollow bodies 329 which form the hollow chamber 329*a* with independent hollows which are sealed with regard to the outside, when the ink containing bag 300 receives an external force from the containing box 200, the impact which is caused by the external force is further reduced by the compression of the hollow chambers 329*a* of the hollow bodies 329.

As shown in FIG. 5, the shock buffering section 328*a* is formed on the sheet of the flexible material away from the bonding section 330. This is due to the following reasons. The ink containing bag 300 is formed in a bag shape by bonding sheets which are formed from a flexible material at the bonding section 330. At this time, since the bonding section 330 interposes the shock buffering section 328*a* and receives a crimping force when the bonding section 330 is adhered and formed if the shock buffering section 328*a* is provided in the bonding section 330, a decrease in the crimping force and variation in the bonding state are easily generated. In order to avoid such a decrease in the crimping force and the like, the shock buffering section 328*a* is formed on the sheet of the flexible material away from the bonding section 330.

B. Other Working Examples

B-(1)

Figure 14:
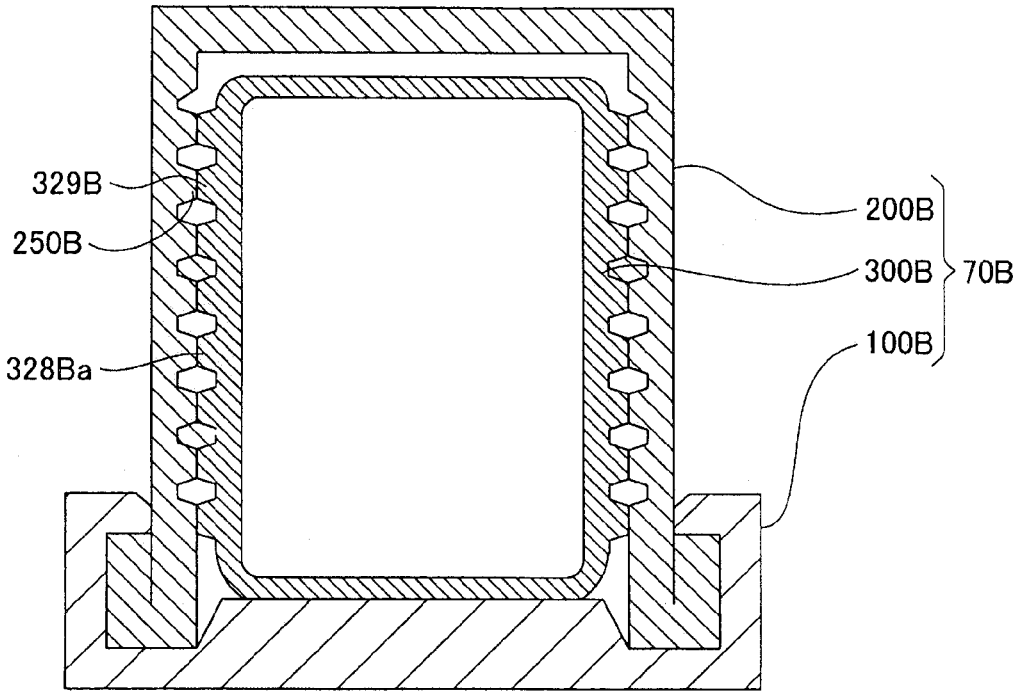
FIG. 14 is a cross sectional diagram illustrating an ink cartridge 70B according to a second working example.

FIG. 14 is a cross sectional diagram illustrating an ink cartridge 70B according to a second working example. The present working example is characterized by the configuration of a containing box 200B. That is, the containing box 200B is formed of cardboard and a box side shock buffering section 250B with a concave and convex shape which functions as a shock buffering material is formed on an inner wall thereof. The box side shock buffering section 250B is formed so as to hit against the top section of hollow bodies 329B of a shock buffering section 328Ba of an ink containing bag 300B. In the present working example, by the top section of the shock buffering section 328Ba of the ink containing bag 300B hitting against the box side shock buffering section 250B of the containing box 200B, the ink containing bag 300B is positionally aligned with regard to the containing box 200B. As such, it is possible for the liquid containing bag 300B to reduce rattling of the liquid containing bag 300B, in particular, it is possible to buffer against an impact which is applied to the place of connection with a flow path member 100B, and it is possible to further prevent leaking of liquid.

B-(2)

Figure 15:
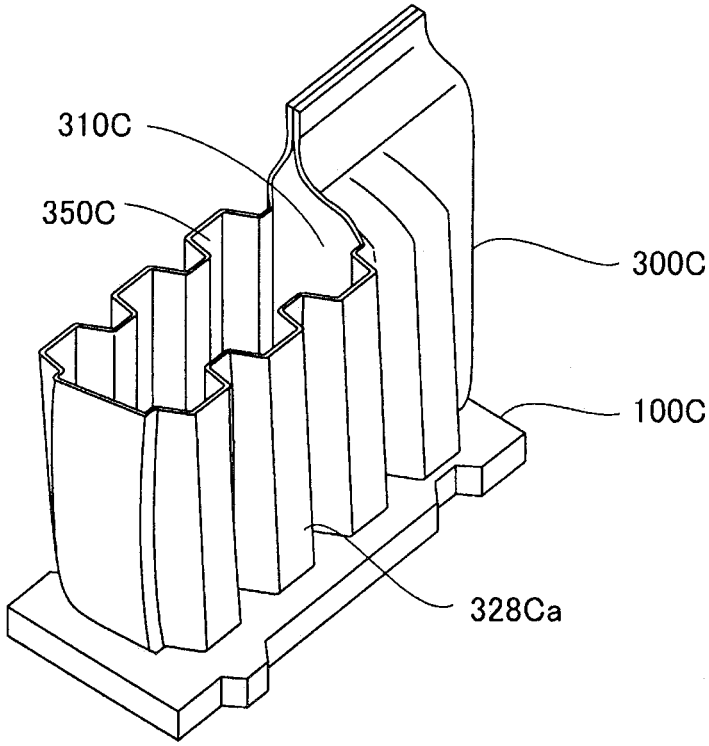
FIG. 15 is a perspective diagram in which an ink containing bag 300C according to a third working example is partially cut away.

FIG. 15 is a perspective diagram in which an ink containing bag 300C according to a third working example is partially cut away. The present working example is characterized by the shape of the ink containing bag 300C and the configuration of a shock buffering section 328Ca. In FIG. 15, an in-bag flow path 350C is provided in an ink containing space 310C of the ink containing bag 300C. The in-bag flow path 350C is connected to the flow path (refer to FIG. 9) of a flow path member 100C, guides the liquid smoothly to a supply port (refer to FIG. 9), and reduces the remaining amount of the liquid. In addition, the ink containing bag 300C has a concave and convex shape, convex sections of the outer surface thereof become a shock buffering section 328Ca, and concave sections of the inner surface thereof configure a portion of the in-bag flow path 350C. Since the concave sections of the shock buffering section 328Ca of the ink containing bag 300C also are used as a portion of the flow path inside the ink containing bag 300C, it is possible to simplify the in-bag flow path 350C. In this manner, it is possible to simply realize the sheet material which forms the ink containing bag 300C by forming a concave and convex shape in the sheet material by press forming.

B-(3)

The shock buffering section of the ink containing bag according to the working example described above may be provided in a portion of the ink containing bag. For example, in a case where the containing box receives an external force, it is easy for corner portions (angular portions) of the containing box to receive a greater impact than the other portions and the impact is transmitted to the corner portions of the ink containing bag. The shock buffering section which is provided in the corner portion of the ink containing bag in the present working example effectively performs buffering by receiving the impact in a more concentrated manner than other portions. Moreover, since the shock buffering section is provided in a portion of the ink containing bag, it is possible to reduce the amount of materials of the shock buffering section and this is effective in cost reduction. Here, the angular portions of the ink containing bag where the shock buffering section is provided may be portions which protrude toward the containing box from the outermost layer of the ink containing bag other than the corner portions of the ink containing bag, in other words, may be portions which protrude such that the distance to the containing box from the outermost layer of the ink containing bag is narrower than in other portions.

B-(4)

The shock buffering section according to the working example described above has been described with an example which is configured using the hollow shock buffering material 328 which has the hollow bodies 329 with independent hollows, but without being limited thereto, it is possible to use various types of material as long as the member buffers against an impact which is caused by an external force from the containing box 200, and for example, in addition to sponge and rubber, it may be a so-called honeycomb structure such as a hexagon or an octagon which is surrounded by polygonal vertical walls.

B-(5)

In the working example described above, the flexible sheet 320 which is the material of the ink containing bag 300 has a three layer configuration in which the polyethylene layers 322 and 326 are arranged on both sides of the aluminum deposition film 324, but another material (for example, a ceramic deposition film) which has a barrier property may be used instead of the aluminum deposition film 324. In addition, the bag sheet 300A which is the material of the ink containing bag 300 is formed of multiple layers of resin, but may be formed of a plurality of layers mainly composed of paper. In this configuration, the inner layer which is in contact with the ink is formed from a material which is resistant to penetration with regard to the ink, and it is possible for the shock buffering section to be a predetermined three-dimensional structure in the outer layer which is the outer surface. Here, as the three-dimensional structure, it is possible for there to be a waveform which forms a hollow space which utilizes the structure of cardboard, or a so-called honeycomb structure which is surrounded by polygonal vertical walls such as a hexagon or an octagon. Since a plurality of layers are formed from a plant derived material mainly composed of paper in the ink containing bag 300 according to the present working example, it is not necessary to separate a layer which is formed of resin and it is possible to further reduce the environmental burden in the life cycle of the liquid container.

B-(6)

The configuration of the printer 20 in the working example described above is only an example and various modifications are possible. For example, in the working example described above, the printer 20 is a so-called on-carriage type printer in which the ink cartridge 70 moves back and forth in the main scanning direction along with the print head unit 60, but it is possible for the present invention to also be applied to a so-called off-carriage type printer in which a holder in which the ink cartridge 70 is mounted is provided at a separate location to the print head unit 60 and ink is supplied to the print head 61 from the ink cartridge 70 via a flexible tube or the like. In addition, in the working example described above, the printer 20 is a so-called serial type printer which performs printing while repeating an operation (main scanning) in which the print head unit 60 is moved back and forth in the main scanning direction and an operation (sub-scanning) in which the paper is transported in a transport direction which intersects with the main scanning direction, but it is possible for the present invention to also be applied to a so-called impact printer in which printing is performed on single sheets of paper or a so-called line head type printer in which printing is performed while transporting paper in a direction which intersects the paper width direction under nozzle rows which are lined up and installed in the lower surface of the print head across the paper width length.

B-(7)

In addition, it is possible for the present invention to also be applied to a liquid container which is mounted in a liquid consuming apparatus other than an ink jet printer as long as it is a liquid container which is mounted in an apparatus which consumes a liquid (which includes liquid bodies in which particles of functional materials are dispersed or flowing bodies such as gels). Examples of such a liquid consuming apparatus include a textile printing apparatus for adhering a pattern to a fabric, an apparatus which ejects a liquid which includes a material such as an electrode material or a coloring material which is used for manufacturing a liquid crystal display, an EL (electro luminescence) display, a surface-emitting display, a color filter or the like in a dispersed or dissolved form, an apparatus which ejects biological organic matter which is used in biochip manufacturing, an apparatus which is used as a precision pipette and which ejects a liquid which is a sample, an apparatus which ejects lubricant in a pin point manner in precision machines such as watches and cameras, an apparatus which ejects a transparent resin liquid such as an ultraviolet curing resin for forming a micro hemispherical lens (optical lens) which is used in optical communication elements or the like on a substrate, an apparatus which ejects an etching liquid such as an acid or an alkali for etching a substrate or the like, or the like.

B-(8)

In the working example described above, the paper material 220 which is the material of the containing box 200 has a three layer configuration in which the polyethylene layers 222 and 226 are arranged on both sides of the paper 224, but the polyethylene layer on one or both sides of the paper material 220 may be omitted. In addition, the paper material 220 may be configured by four layers or more, which include other layers. In addition, the containing box 200 may be formed from another plant derived material (for example, a bioplastic such as polylactic acid (PLA)).

B-(9)

In the working example described above, six of the ink cartridges 70 are mounted in the holder 62, but it is sufficient if the number of the ink cartridges 70 which are able to be mounted in the holder 62 is one or more. In addition, a plurality of the ink cartridges 70, where inks with the same characteristics are contained, may be mounted in the holder 62.

Here, the present invention is not limited to the embodiments, working examples, and modified examples described above, and the realization of various configurations is possible in a range which does not depart from the spirit of the present invention. For example, it is possible for the technical characteristics in the embodiments, working examples, and modified examples which correspond to the technical characteristics in each of the aspects according to the Summary of the Invention section to be replaced or combined as appropriate in order to solve a portion or all of the problems described above, or in order to achieve a portion of all of the effects described above. In addition, where a technical characteristic is not described as one which is essential in the present specifications, it is able to be removed as appropriate.

What is claimed is:

1. A liquid container configured to be mounted in a liquid container holder of a liquid consuming apparatus, the liquid container comprising:

a liquid containing bag formed in a bag shape and capable of containing a liquid in an inner portion of the liquid containing bag;

a flow path member having a flow path that is configured to guide the liquid contained in the liquid containing bag to an outside, and having a supply port connected to the flow path; and a containing box accommodating the liquid containing bag and including a plant derived material, wherein the liquid containing bag has a layer forming an outer surface of the liquid containing bag, the layer includes a shock buffering section that is configured to buffer against an impact from the outside via the containing box.

2. The liquid container according to claim 1, wherein the shock buffering section is arranged at least at an angular portion of the liquid containing bag.

3. The liquid container according to claim 1, wherein the shock buffering section includes a hollow shock buffering material having a plurality of hollow bodies each forming a hollow chamber.

4. The liquid container according to claim 1, wherein the liquid containing bag is a bag in which at least two flexible sheets are bonded at a bonding section, and the shock buffering section is formed on a surface of the flexible sheet other than the bonding section.

5. The liquid container according to claim 1, wherein the liquid containing bag has a first layer and a second layer each of which includes a material mainly composed of paper, the first layer includes a material that is resistant to penetration with regard to the liquid, and the second layer has the shock buffering section including a three-dimensional structure.

6. The liquid container according to claim 1, wherein the liquid containing bag is provided with an in-bag flow path that is configured to guide the liquid contained in a liquid containing space of the inner portion thereof to the supply port, and the shock buffering section is provided with a concave section formed to face the liquid containing space of the liquid containing bag, and the concave section constitutes a portion of the in-bag flow path.

7. The liquid container according to claim 1, wherein the containing box is provided with a box side shock buffering section that is configured to buffer against an impact from the outside when a top portion of the shock buffering section hits an inner wall portion that opposes the shock buffering section.

8. A liquid container configured to be mounted in a liquid container holder of a liquid consuming apparatus, the liquid container comprising:

a liquid containing bag formed in a bag shape and capable of containing a liquid in an inner portion of the liquid containing bag;

a flow path member having a flow path that is configured to guide the liquid contained in the liquid containing bag to an outside and a supply port connected to the flow path; and a containing box accommodating the liquid containing bag and including a plant derived material, wherein the liquid containing bag has a first layer and a second layer, the first layer includes a material that is resistant to penetration with regard to the liquid, and the second layer has a shock buffering section that includes a hollow shock buffering material having a plurality of hollow bodies each forming a hollow chamber.

* * * * *